US010815113B2

(12) United States Patent
Lambrecht et al.

(10) Patent No.: US 10,815,113 B2
(45) Date of Patent: Oct. 27, 2020

(54) BEVERAGE DISPENSER AND CONTAINER STOPPER

(71) Applicant: Coravin, Inc., Burlington, MA (US)

(72) Inventors: Gregory Lambrecht, Natick, MA (US); Michael Rider, Lowell, MA (US); Otto DeRuntz, Dunstable, MA (US)

(73) Assignee: Coravin, Inc., Bedford, MA (US)

( * ) Notice: Subject to any disclaimer, the term of this patent is extended or adjusted under 35 U.S.C. 154(b) by 0 days.

(21) Appl. No.: 16/235,015

(22) Filed: Dec. 28, 2018

(65) Prior Publication Data

US 2019/0210859 A1 Jul. 11, 2019

Related U.S. Application Data

(60) Provisional application No. 62/659,764, filed on Apr. 19, 2018, provisional application No. 62/613,791, filed on Jan. 5, 2018.

(51) Int. Cl.

| | |
|---|---|
| ***B67D 1/04*** | (2006.01) |
| ***B67D 1/00*** | (2006.01) |
| ***B67D 1/12*** | (2006.01) |

(52) U.S. Cl.

CPC ..... *B67D 1/0081* (2013.01); *B67D 1/0004* (2013.01); *B67D 1/0412* (2013.01);
(Continued)

(58) Field of Classification Search

CPC .. B67D 1/0081; B67D 1/0412; B67D 1/0418; B67D 1/0885; B67D 1/0004;
(Continued)

(56) References Cited

U.S. PATENT DOCUMENTS 718,163 A * 1/1903 Sherrard ..... B67D 1/0425 222/82
2,205,938 A 6/1940 Ward
(Continued)

FOREIGN PATENT DOCUMENTS

EP 2 129 596 B1 5/2013
EP 2 731 904 B1 11/2017
(Continued)

OTHER PUBLICATIONS

International Search Report and Written Opinion for International Application No. PCT/US2018/067870, dated Jul. 9, 2019.
(Continued)

*Primary Examiner* — Charles Cheyney
(74) *Attorney, Agent, or Firm* — Wolf, Greenfield & Sacks, P.C.

(57) ABSTRACT

A beverage dispensing apparatus may include a beverage dispenser and associated stopper. The stopper may be used to replace a cork, cap or other closure of a beverage container, such as a wine bottle. A needle of the beverage dispenser may be inserted through a passageway of the stopper so that pressurized gas can be introduced into the container to force beverage liquid to exit the container via the needle. The stopper may suitably seal the container after dispensing is complete, e.g., to resist exposing the beverage to oxygen.

17 Claims, 4 Drawing Sheets

(52) U.S. Cl.
CPC ..... *B67D 1/0418* (2013.01); *B67D 1/1252* (2013.01); *B67D 2001/0481* (2013.01); *B67D 2001/0487* (2013.01)

(58) Field of Classification Search
CPC .... B67D 2001/0481; B67D 2001/0092; B67D 2001/0487
USPC ..... 222/399, 400.7, 152, 396
See application file for complete search history.

(56) References Cited

U.S. PATENT DOCUMENTS 3,372,838 A * 3/1968 Smith ..... B67D 1/0412 222/61
3,883,043 A * 5/1975 Lane ..... B67D 1/0412 222/82
4,011,971 A * 3/1977 Haydon ..... B67D 1/0412 222/399
4,702,396 A * 10/1987 Gwiazda ..... B65D 83/66 215/311
4,934,543 A * 6/1990 Schmidt ..... B65D 85/73 215/228
4,984,711 A * 1/1991 Ellis ..... B67B 7/26 222/152
5,924,584 A * 7/1999 Hellstrom ..... A61J 1/2096 215/247
7,712,631 B2 5/2010 Taradalsky et al.
8,272,538 B2 * 9/2012 Weinberg ..... B67D 1/0418 222/152
9,181,021 B2 * 11/2015 Manera ..... B65D 83/32
9,238,574 B2 * 1/2016 Hollers ..... B67D 1/0412
10,232,994 B2 * 3/2019 Peirsman ..... F16K 15/147
10,258,937 B2 * 4/2019 Hubbard, Jr. ..... B01F 3/04794
2010/0276453 A1 11/2010 Vandaele
2011/0130740 A1 * 6/2011 Levy ..... A61J 1/05 604/403
2011/0204093 A1 * 8/2011 Lee ..... B67D 1/0004 222/152
2014/0263453 A1 9/2014 Haley et al.
2017/0137275 A1 5/2017 Lambrecht et al.

FOREIGN PATENT DOCUMENTS

GB 1 004 209 A 9/1966
WO WO 94/03373 A1 2/1994
WO WO 2008/058326 A1 5/2008
WO WO 2014/200881 A2 12/2014
WO WO 2017/223138 A1 12/2017
WO WO 2019/005934 A1 1/2019

OTHER PUBLICATIONS

Invitation to Pay Additional Fees for International Application No. PCT/US2018/067870, dated Apr. 3, 2019.
PCT/US2018/067870, Jul. 9, 2019, International Search Report and Written Opinion.

* cited by examiner

BEVERAGE DISPENSER AND CONTAINER STOPPER

RELATED APPLICATIONS

This Application claims priority under 35 U.S.C. § 119(e) to U.S. Provisional Application Ser. No. 62/613,791, filed Jan. 5, 2018, and U.S. Provisional Application Ser. No. 62/659,764, filed Apr. 19, 2018, each of which is herein incorporated by reference in its entirety.

BACKGROUND OF INVENTION

This invention relates generally to the dispensing or other extraction of fluids from within a container, e.g., the dispensing of wine from a wine bottle.

SUMMARY OF INVENTION

One or more embodiments in accordance with aspects of the invention allow a user to withdraw or otherwise extract a beverage, such as wine, from within a container that is sealed by a stopper without removing the stopper. The stopper is specially arranged to operate with a beverage dispenser, and replaces a cork, screw cap or other closure of the beverage container. For example, a wine bottle with a cork may have the cork removed and replaced with a stopper that closes the bottle opening. With the stopper in place, removal of liquid from the bottle may be performed one or more times, yet the stopper may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage may be introduced into the container either during or after extraction of beverage from within the container. Thus, in some embodiments, a user may withdraw wine from a wine bottle without removal of a stopper once the stopper is put in place and without allowing air or other potentially damaging gasses or liquids entry into the bottle.

In one aspect of the invention, a beverage dispenser apparatus includes a pressurized gas receiver arranged to fluidly couple with a pressurized gas source and conduct flow of pressurized gas along a primary gas conduit. For example, the pressurized gas receiver may include a piercing lance arranged to pierce the cap or closure of a compressed gas cylinder as well as an arrangement to force the gas cylinder into engagement with the piercing lance. A gas flow valve may be fluidly coupled to the primary gas conduit and arranged to control flow of gas from the primary gas conduit to a secondary gas conduit. For example, the gas flow valve may be manually operated via an actuator to open and close to permit and stop gas flow to the secondary gas conduit. Alternately, a controller may be arranged to automatically control operation of the gas flow valve based on an orientation of the dispenser, e.g., so that gas flow is permitted when a dispenser body is oriented in a pour orientation and is prevented when the body is in a no-pour orientation. A needle of the dispenser may include a needle gas conduit fluidly coupled to the secondary gas conduit and arranged to deliver pressurized gas to a distal end of the needle, and a needle beverage conduit arranged to conduct a flow of beverage from the distal end of the needle to a dispensing outlet. (As used herein, a "needle" refers to one or more conduits that provide for fluid flow, whether gas and/or liquid. No limitation on a size of a "needle" whether in diameter and/or length should be inferred as a "needle" may have any suitable diameter or other size in a direction transverse to the length of the needle. Also, a "needle" need not have a sharp point or distal end, but rather may be blunt.) In some embodiments, the needle gas conduit may be positioned inside of the needle beverage conduit, e.g., so that the needle beverage conduit defines an outer surface of the needle. The needle gas conduit may deliver pressurized gas to a gas outlet at an extreme distal tip or other location of the needle, and the needle beverage conduit may have one or more beverage inlet openings positioned proximal of the gas outlet. A body of the dispenser apparatus may house the primary gas conduit, gas flow valve, and secondary gas conduit, and the needle may extend from a portion of the body so that the needle can be inserted at least partially into a beverage container. This may allow the dispenser to introduce pressurized gas into the container via the needle so as to force beverage to flow into the needle and exit the container for dispensing, e.g., into a user's cup. In some cases, the body includes a handle that is grippable by a user, and the dispensing outlet may include a tube that is fluidly coupled to the beverage conduit and extends from the body to dispense beverage.

In one embodiment, the primary gas conduit may include a flow restrictor to reduce a pressure of gas flowing in the primary gas conduit and provide a desired flow rate of gas. In one preferred embodiment, the flow restrictor is integrated with a piercing lance, e.g., the flow restrictor is formed as an orifice or other suitably sized flow path of the piercing lance. The flow restrictor may be useful where the pressurized gas source provides gas at a relatively high pressure, e.g., 2000 psi or more, and may allow for the elimination of a pressure regulator. If used, a pressure regulator may be provided downstream of the flow restrictor. In cases where the flow restrictor is integrated with a piercing lance, the flow restrictor may additionally allow portions of the primary gas conduit and other gas-carrying portions to be made less robustly than otherwise because of the pressure reduction provided by the flow restrictor. In some embodiments, the flow restrictor may have a size or other characteristics to provide a flow rate of 0.7 L/min to 5 L/min when provided at an inlet side with gas at a pressure of 1000 to 3500 psi. A second flow restrictor may be provided in the secondary gas conduit downstream of the gas flow valve to further reduce a flow rate and pressure of gas flowing in the secondary gas conduit. This second flow restrictor may have a size or other characteristics to provide a flow rate of 0.7 L/min to 5 L/min when supplied at an inlet side with gas at a pressure of 30 to 200 psi. In some embodiments, the first and/or second flow restrictors may include an orifice of suitable diameter and/or length to provide desired flow characteristics. For example, an orifice for the first and/or second flow restrictor may have a size of 0.02 mm to 0.4 mm to provide desired flow rate and output pressure characteristics for input pressures of 100 psi to 3000 psi. Output pressure for the orifice may range from 15 psi to 50 psi in this example. In some embodiments, a first flow restrictor upstream of a gas control valve may be eliminated, and only one flow restrictor (the second flow restrictor) may be provided downstream of the gas control valve.

In another aspect of the invention, a stopper may be arranged to engage with an opening of a beverage container and may be used with a beverage dispenser to dispense beverage from the container. The stopper may have a passageway extending through a stopper body from a distal end to a proximal end, with the stopper including a radial seal positioned between the distal and proximal ends of the passageway. The radial seal may be arranged to sealingly engage with the dispenser needle with the needle inserted through the passageway so as to position the distal end of the needle beyond the distal end of the passageway (and therefore within a container). A septum seal or other valve may be positioned in the passageway, e.g., proximally relative to the radial seal, and arranged to resist fluid flow through the passageway but to permit the needle to be inserted through the passageway. A septum seal may include an X-seal having a resilient membrane with a slit opening having an X shape. The septum seal or other valve may serve to close the passageway to flow, at least temporarily, when the needle is withdrawn from the passageway. Other valve types which may be employed include duckbill, single slit membrane, dome and ball valves, to name just a few options. To more permanently close the passageway, the stopper may include a cap arranged to close the passageway to fluid flow at the proximal end of the passageway, e.g., by inserting a portion of the cap into the passageway.

In some embodiments, the stopper may be arranged to sealingly engage with a container neck at the container opening. In some cases, the stopper includes an insertion portion arranged to be inserted within the opening of the container, with the insertion portion including one or more ribs extending radially outwardly from the insertion portion to engage with container openings of different size and resist fluid flow in a space between the stopper and the container opening. In some embodiments, one or more distal ribs may be arranged to engage with the opening, and one or more proximal ribs positioned proximally of the one or more distal ribs may also be arranged to engage with the opening. The one or more distal ribs may have a different arrangement or function than the one or more proximal ribs, e.g., the distal ribs may have a higher impermeability to oxygen than the one or more proximal ribs, and/or the proximal ribs may provide better frictional engagement with a container opening than the distal ribs. In some cases, one or more ribs are formed on a sleeve that is positioned over a distal end of a molded plastic body of the stopper.

In some embodiments, the stopper may engage with the exterior surface of a container neck so as to secure the stopper to the container. For example, the stopper may include a female threaded portion that engages with a male thread on the container neck, e.g., where the stopper replaces a screw cap on the container. In other arrangements, the stopper may engage the container neck exterior, including a lip of the neck, with a friction fit (e.g., by forcing a resilient sleeve over the container neck), clamp, or other suitable engagement portion. In other embodiments, the stopper may engage with the inner surface of the container neck, e.g., using an expanding seal configuration similar to that used in compression type fittings. A ring shaped seal may be expanded radially outwardly by one or more conical elements that are forced into an inner space of the ring seal to push the seal radially outwardly and into contact with the inner surface of the neck. In other arrangements, the ring seal may be squeezed axially, causing the ring seal to bulge outwardly in a radial direction so as to sealingly contact with the inner surface of the neck.

In some embodiments, the stopper and the beverage dispenser may be arranged to resist rotation or other relative movement between the dispenser and the stopper. For example, the stopper body may include a plurality of ridges that extend around a portion of the body around the proximal end of the passageway. The plurality of ridges may be configured to engage with the beverage dispenser to resist rotation of the beverage dispenser relative to the stopper. For example, the dispenser may include a detent, such as a spring-loaded plunger, arranged to engage with the plurality of ridges to resist rotation of the dispenser relative to the stopper, e.g., about an axis parallel to a length or longitudinal axis of the needle. In some cases, the stopper body includes a protrusion that extends upwardly from the body and the plurality of ridges are formed on the protrusion. In some embodiments, the stopper and beverage dispenser may be fixed together. Thus, rather than first engage a stopper with a container opening, and then insert the needle of the beverage dispenser through the passageway of the stopper, the stopper and beverage dispenser may be together engaged with a container opening so that a portion of the stopper and at least the distal end of the needle are inserted into the container at a same time. Engagement of the stopper and beverage dispenser may be permanent so the two cannot be separated without damage to one or both components, or may be temporary.

In one embodiment, a beverage dispenser includes a pressurized gas receiver arranged to fluidly couple with a pressurized gas source and conduct flow of pressurized gas along a primary gas conduit, a gas flow valve fluidly coupled to the primary gas conduit and arranged to control flow of gas from the primary gas conduit to a secondary gas conduit, and a needle including a needle gas conduit fluidly coupled to the secondary gas conduit and arranged to deliver pressurized gas to a distal end of the needle. The needle further includes a needle beverage conduit arranged to conduct a flow of beverage from the distal end of the needle to a dispensing outlet. A dispenser body houses the primary gas conduit, gas flow valve, and secondary gas conduit, and the needle extends from a portion of the body. A stopper may be arranged to operate with the dispenser, and may be arranged to engage with an opening of a beverage container. A passageway of the stopper may extend from a distal end to a proximal end with a radial seal positioned between the distal and proximal ends of the passageway. The radial seal may sealingly engage the needle with the needle inserted through the passageway so as to position the distal end of the needle beyond the distal end of the passageway, e.g., so the stopper and dispenser sealingly close the opening of the container. The stopper may be configured to support the dispenser body on a container in which the stopper is engaged, e.g., so the entire weight of the dispenser is supported on the container by the stopper. Other features detailed above regarding the dispenser and/or stopper may be incorporated into this embodiment, such as the seal arrangements of the stopper, automatic control features of the dispenser, flow restriction features for the dispenser, etc.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

Figure 1:
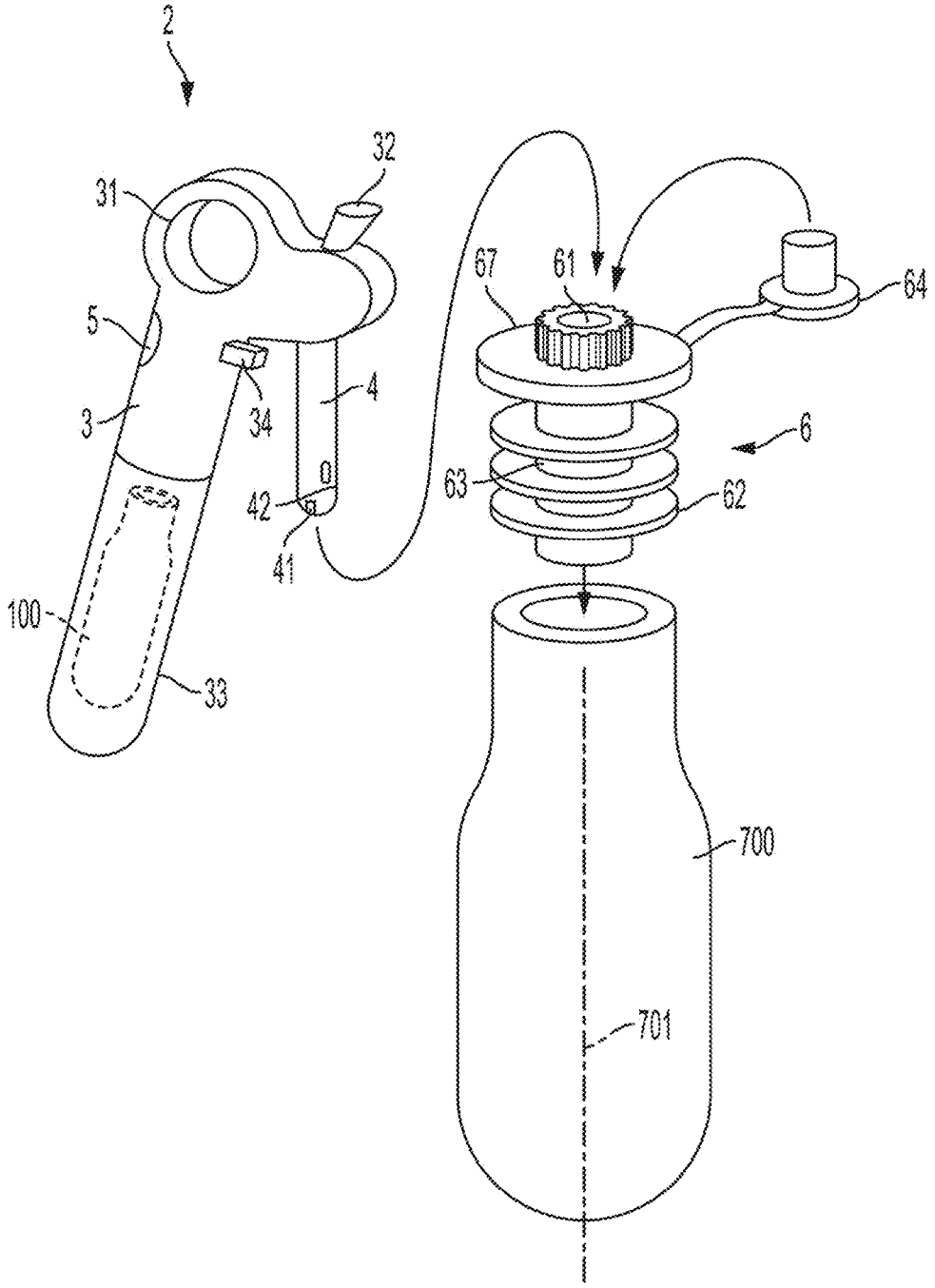
FIG. 1 shows an illustrative embodiment of a beverage extraction apparatus that incorporates aspects of the invention.

FIG. 1 shows an illustrative embodiment of a beverage extraction apparatus 1 that incorporates one or more aspects of the invention. This illustrative apparatus 1 includes a dispenser 2 having a body 3 with a handle 31 arranged to allow a user to grasp or hold the dispenser body 3 with one or more fingers. A needle 4 extends from the body 3 and includes a gas conduit and a beverage conduit. A source of pressurized gas 100, such as a compressed gas cylinder, is coupled to the body 3 and provides pressurized gas that is delivered to the gas conduit of the needle 4. An actuator 5, such as a button or lever, may be operated by a user to cause gas to flow from the pressurized gas source 100 to the needle gas conduit. Alternately, as discussed in more detail below, the apparatus 1 may include a controller arranged to automatically control gas flow from the gas source 100 to the needle gas conduit of the needle 4, e.g., based on an orientation of the body 3. The apparatus 1 in this embodiment includes a stopper 6 that may be used to replace a cork or other closure (not shown) of a beverage container 700, such as a wine bottle. That is, the cork, screw cap or other closure may be pulled or otherwise removed from the opening of the container 700, and the stopper 6 used in its place to close the opening of the container 700. In this embodiment, one or more ribs 62 on an insertion portion 63 of the stopper 6 may engage with the inner surface of the container opening to resist passage of gas and/or liquid in a space between the stopper 6 and the container opening. With the stopper 6 in place, the needle 4 of the dispenser may be inserted into a passageway 61 of the stopper 6 so that a distal end of the needle 4 is inserted into the container 700. Alternately, the stopper 6 may be first engaged with the needle 4, and then the dispenser 2 and stopper 6 engaged with the container opening. In some cases, the stopper 6 and dispenser 2 may be permanently attached so the two components are not separable. The stopper 6 may be arranged to support the dispenser 2 on the container 700, e.g., so that the container 700 can be manipulated and the dispenser 2 moves with the container 700. Alternately, or in addition, the stopper 6 may support the dispenser 2 so that a user can grasp the dispenser 2 alone and manipulate the container 700 by moving the dispenser 2.

With the distal end of the needle 4 positioned in the interior of the container 700, pressurized gas may be delivered into the container 700 via a gas outlet 41 of the needle gas conduit to pressurize the interior of the container 700. The container 700 may be tilted or otherwise oriented so that beverage can be forced by pressure in the container 700 to flow into a beverage inlet 42 of the beverage conduit of the needle 4 and dispensed via the dispense outlet 32. A screen or other element may be provided in the dispense outlet 32 to smooth the flow of beverage, e.g., to reduce splashing. As shown in FIG. 1, the gas outlet 41, which may include one or more openings, may be positioned at an extreme distal end of the needle 4 or other location at or near the distal end of the needle 4, whereas the beverage inlet 42 (which also may include one or more openings) may be positioned proximally of the gas outlet 41. Positioning the beverage inlet 42 proximally of the gas outlet 41 may help prevent crosstalk, i.e., the passage of gas exiting the gas outlet 41 into the beverage inlet 42. When dispensing is complete, the needle 4 may be withdrawn from the stopper 6 and a cap 64 used to close the proximal end of the passageway 61, e.g., to resist gas and/or liquid flow through the passageway 61. Since an inert or otherwise minimally reactive gas may be introduced into the container 700 via the needle 4 for dispensing beverage, the beverage in the container 700 may avoid most or all contact with air or other ambient gas both during and after dispensing.

Figure 2:
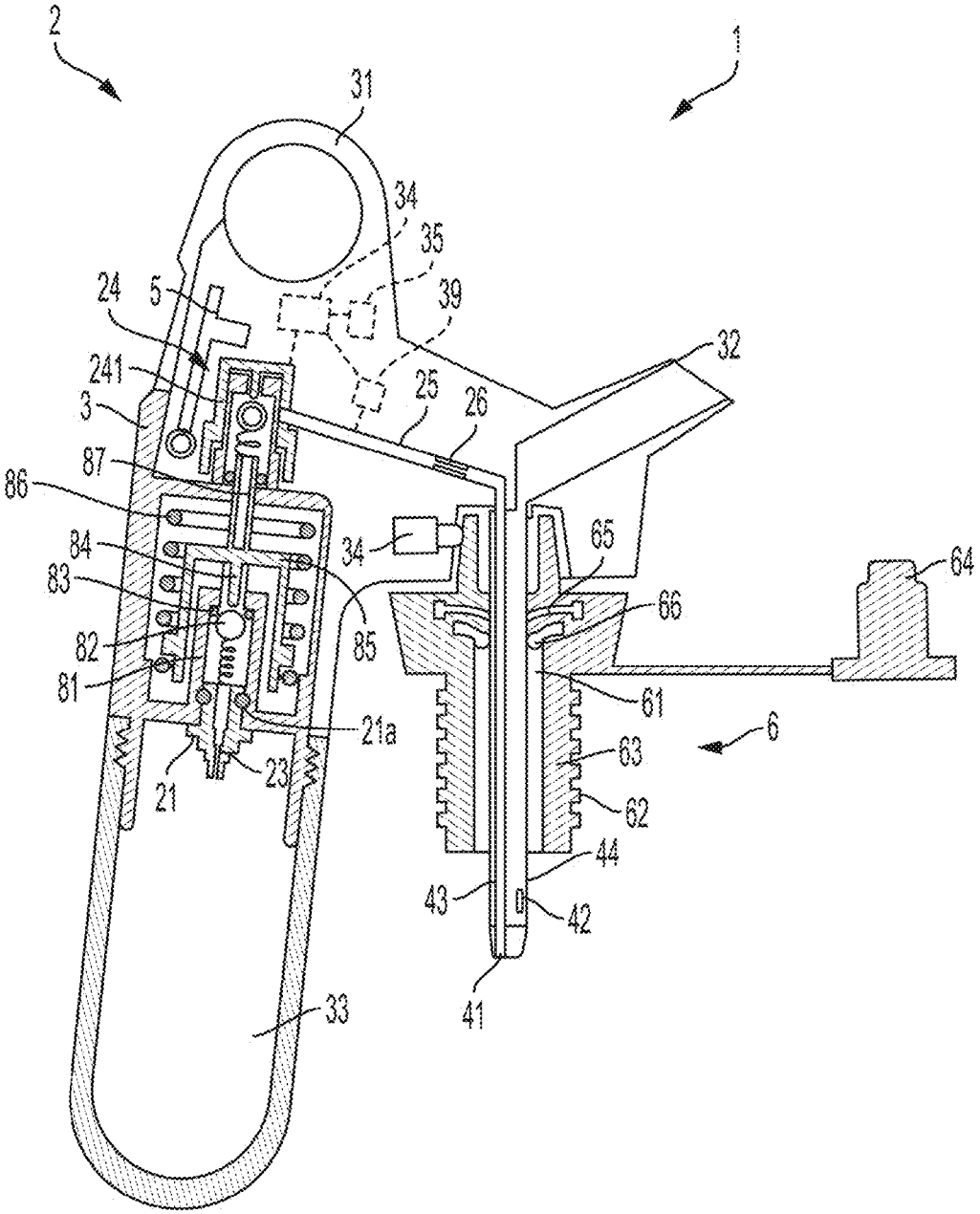
FIG. 2 shows a cross sectional view of the FIG. 1 apparatus with the dispenser needle inserted into the stopper.

FIG. 2 shows a cross sectional view of the beverage dispenser 2 and stopper 6 of FIG. 1 with the needle 4 inserted into the stopper 6. In this embodiment, the dispenser 2 includes a pressurized gas receiver having a piercing lance 21 arranged to pierce a cap or other closure on a compressed gas cylinder (not shown in FIG. 2). In this embodiment, a gas cylinder is forced into engagement with the piercing lance 21 by a cup or holder 33 that is threadedly engaged with the body 3 so that as the cup 33 is threaded onto the body 3, the gas cylinder is moved toward and held against the piercing lance 21. It should be understood, however, that other arrangements are possible for engaging the gas cylinder with a piercing lance 21, such a threaded connection between the cylinder and the lance, and others such as those described in U.S. Pat. Nos. 4,867,209; 5,020,395; 5,163,909 and 9,810,375 which are hereby incorporated by reference with respect to their teachings regarding mechanisms for engaging a gas cylinder with a piercing lance or other cylinder receiver.

Gas released by the gas cylinder is received by a primary gas conduit that is defined at least in part by a flow path in the piercing lance 21. In accordance with an aspect of the invention, a flow restrictor 23 may be integrated with the piercing lance 21. The flow restrictor 23 may assist in reducing the pressure and/or flow rate of gas received from the gas cylinder, which may be 2000 psi or more within the gas cylinder. Previously, a flow restrictor has not been integrated with a gas cylinder piercing lance because of a concern for reducing flow rate below desired levels. However, the inventors have found that a flow restrictor may be integrated with a piercing lance so as to provide desired flow rate and pressure for dispensing beverage while potentially eliminating the need to design gas-handling portions of the dispenser to withstand high gas pressures and/or the need for a pressure regulator. Since the flow restrictor 23 may be integrated with the piercing lance 21, portions of the dispenser 2 that handle the pressurized gas flow may be made less robust with the reduced need to withstand high pressures, and/or a regulator may be eliminated, saving cost and weight. The flow restrictor 23 may have a size of 0.02 mm to 0.4 mm to provide desired flow rate and output pressure characteristics and may be machined, molded or otherwise formed in the material, such as a metal, that forms the piercing lance 21. For example, a flow restrictor 23 having an orifice with a size of 0.02 mm to 0.4 mm may be provided with gas at a pressure of 100 psi to 3000 psi and provide a flow of gas with an output pressure of 15 to 50 psi and at a flow rate of 0.7 L/min to 5 L/min.

Although not necessarily required, in this embodiment, the dispenser 2 includes a regulator 8. The regulator 8 may be formed in different ways, and any of a variety of commercially available or other single or multi-stage pressure regulators capable of regulating gas pressures to a pre-set or variable outlet pressure can be employed. The main function of the regulator 8 is to provide gas at a pressure and flow rate suitable for delivery to the container 700 (such as a wine bottle), e.g., so that a pressure established inside the container 700 does not exceed a desired level but allows for proper beverage dispensing. In this embodiment, the regulator 8 includes a chamber body with an opening into which the piercing lance 21 may be press fit. The lance 21 may include an annular groove and sealing ring 21*a* that creates an airtight seal between lance 21 and the chamber body, e.g., so gas received from the gas cylinder 100 does not leak past the sealing ring 28. A valve chamber 81 in the chamber body forms part of the primary gas conduit and receives relatively high pressure gas from the gas cylinder via the piercing lance 21 and the flow restrictor 23. Flow of gas from the valve chamber 81 is controlled by a valve assembly that includes a spring-biased ball 82 that is normally urged into contact with a sealing ring 83, e.g., a resilient o-ring, to close the valve assembly so flow is not permitted from the valve chamber 81. Movement of the ball 82 is controlled by a plunger 84, which is attached to a piston 85 arranged for movement relative to the valve chamber 81. A piston spring 86 urges the piston 85 to move downwardly and thus moves the plunger 84 and ball 82 downwardly, while gas pressure (provided by gas emitted from the valve chamber 81) at an inner, bottom surface of the piston 85 urges the piston 85 to move upwardly (and thus moves the plunger 84 upwardly, allowing the spring to move the ball 82 upwardly). Thus, when the piston 85 is moved downwardly by the piston spring 86, flow from the valve chamber 81 is permitted, and when the piston 85 is moved upwardly, flow from the valve chamber 81 is stopped. As will be understood by those of skill in the art, movement of the piston 85, and the corresponding movement of the plunger 84 and ball 82 as influenced by the piston spring 86 and pressure inside of the piston 85, will provide a pressure-regulated flow of gas from the valve chamber 81 to a regulator outlet conduit 87. In this embodiment, the flow path through the regulator 8 to and including the regulator outlet conduit 87 defines in part the primary gas conduit.

In fluid communication with the primary gas conduit is a gas flow valve 24 that controls gas flow from the primary gas conduit to a secondary gas conduit (which in this case includes a tube 25). In this embodiment, the gas flow valve 24 is configured similarly to the regulator valve assembly, but any suitable valve configuration may be used. In this example, gas released by the regulator 8 is delivered by the outlet conduit 87 to a valve chamber of the gas flow valve 24. The valve chamber of the gas flow valve 24 includes a spring-biased ball that is movable by a plunger attached to a cap 241 that is moved by the actuator 5. When the cap 241 is moved downwardly, the ball is moved by the plunger to open the gas flow valve 24, and when the actuator 5 and cap 241 are released, the spring biases the ball and the cap 241 upwardly to close the gas flow valve 24. Of course, other valve arrangements for controlling pressurized gas flow are possible. In short, details regarding the operation of the regulator 8 and gas flow valve 24 are not necessarily limitations on aspects of the invention and may be modified as suitable.

Pressurized gas released by the gas flow valve 24 is delivered to the secondary gas conduit, which in this embodiment includes a tube 25 that is fluidly coupled to the interior space of the cap 241. In accordance with another aspect of the invention, the secondary gas conduit includes a secondary flow restrictor 26 which may help reduce a flow rate and/or pressure of gas delivered by the secondary gas conduit to a needle gas conduit 43. The flow restrictor 26 may have a size of 0.02 mm to 0.4 mm to provide desired flow rate and output pressure characteristics for input pressures of 100 psi to 3000 psi, and may be machined, molded or otherwise formed of any suitable material, such as a metal. Note that in one embodiment in accordance with the invention, the flow restrictor 26 may be used alone without a flow restrictor 23 or regulator 8 to control pressure and/or flow rate of gas.

As mentioned above, the needle 4 in this embodiment includes the needle gas conduit 43 which is fluidly coupled to the secondary gas conduit and extends to the gas outlet 41 at a distal end of the needle 4. The needle gas conduit 43 extends inside of a needle beverage conduit 44 which in this case defines the outer surface of the needle 4. Other configurations are possible, including locating the needle gas conduit 43 and beverage conduit 44 in a side-by-side fashion or locating the beverage conduit 44 inside of the gas conduit 43. In this embodiment, the needle beverage conduit 44 has a diameter or other size in a plane transverse to the length of the beverage conduit 44 of about 2-3 mm to 10-15 mm and a length of 3 to 10 cm, although other sizes can be used. The gas conduit 43 may have a smaller diameter or size, e.g., of 1 mm to 4 mm. The needle beverage conduit 44 is a hollow tube that is fluidly coupled to the dispensing outlet 32 so that beverage liquid received at the beverage inlet 42 can be conducted to the dispensing outlet 32. (The distal end of the needle beverage conduit 44 is closed so pressurized beverage is forced to flow to the dispensing outlet 32.) As shown in FIG. 2, the needle 4 is arranged to be inserted into the passageway 61 of the stopper 6 so that the distal end of the needle 4 is positioned past the distal end of the passageway 61. This places the gas outlet 41 and the beverage inlet 42 in fluid communication with the interior of the container 700. When dispensing beverage, the dispenser 2 introduces pressurized gas into the container 700 interior via the gas inlet 41 so that beverage liquid can be forced into the beverage inlet 42 to flow to the dispensing outlet 32. To aid in this operation, the stopper 6 is arranged to sealingly engage the container opening with ribs 62 or other seal features at an insertion portion 63 that is inserted into the container opening. The insertion portion 63 may include one or more ribs 62 which may extend radially outwardly from the insertion portion 63 and may be resilient to contact the container opening and create a suitable seal to resist gas and/or liquid flow through the space between the stopper 6 and the container 700. Of course, other arrangements are possible to engage a stopper 6 with a container 700, such as providing the stopper 6 with a female thread to engage with a male thread on an outer surface of the container neck, e.g., as found with some wine bottles having a screw cap closure. In another embodiment, the stopper 6 may include an expandable seal element that increases in diameter to press against the interior surface of the container opening and form a suitable seal.

Figure 3:
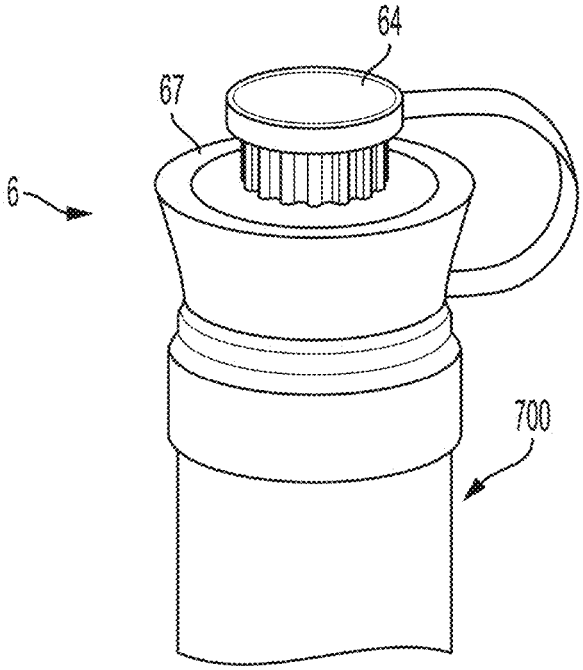
FIG. 3 shows a perspective view of the FIG. 1 stopper with a cap closing the stopper passageway.

To establish a seal with the needle 4 and close the passageway 61 to flow at least to some extent when the needle 4 is not present, the stopper 6 includes a septum seal or other valve 65 that is positioned proximally of a radial seal 66 in the passageway 61. The radial seal 66 may be resilient, e.g., made of a silicone material, and be sized and configured to engage with the needle 4 outside surface to create a suitable seal so that pressure in the container 700 may be maintained as needed to dispense beverage from the container 700. The radial seal 66 may have a toroidally shaped or otherwise suitably shaped portion that is sized and shaped to suitably squeeze or otherwise press radially inwardly on the needle 4 outer surface, i.e., the outer surface of the beverage conduit 44 in this case. In this embodiment, the needle 4 has a circular shape in cross section transverse to the length of the needle 4, but other shapes are possible including oval, figure-8 (such as where the gas and beverage conduits are joined together along outer surfaces of the conduits), and others. While the radial seal 66 is capable of creating a fluid-tight, pressure-resistant seal with the needle 4, it cannot close the passageway 61 to flow when the needle 4 is removed from the passageway 61. To close the passageway 61 to flow, at least temporarily, when the needle is removed, the septum seal 65 is provided proximally of the radial seal 66. In this embodiment, the septum seal 65 is an X seal formed from a sheet of resilient material with an X-shaped cut in the sheet to form four flexible seal flaps. The flaps move aside as the needle 4 is inserted into the passageway 61 and past the septum seal 65, but move together to close the passageway 61 when the needle 4 is removed. Other septum type or other valves may be employed instead of an X seal, if desired, such as duckbill, ball, dome, single slit membrane and other valves. To better close the passageway 61 to flow, the cap 64 may be engaged with the stopper 6 at the passageway 61, e.g., as shown in FIG. 3. For example, the cap 64 may have an insertion portion that can be inserted into the passageway 61 so as to seal the passageway 61 closed to flow of gas and/or beverage. Any suitable arrangement for the cap 64 may be used, including threaded engagement between the cap 64 and stopper 6 body, and others.

As can also be seen in FIG. 3, the stopper 6 may include a plurality of ridges 67 or other engagement features that can be engaged by the dispenser 2 so as to prevent rotation of the dispenser 2 relative to the stopper 6 with the needle 4 inserted in the passageway 61. In this embodiment, the dispenser 2 includes a detent 34 (see FIGS. 1 and 2) arranged to engage with one or more of the ridges 67, which extend around a portion of the stopper 6 body at the proximal end of the passageway 61. The detent 34 may include a spring loaded plunger that is biased to move toward the needle 4 so that when the needle 4 is inserted into the passageway 61, the plunger is pressed into engagement with one or more ridges 67. This engagement may resist rotation of the dispenser 2 relative to the stopper 6, but may allow rotation if suitably high rotation force is present. Other configurations for helping resist rotation of the dispenser 2 relative to the stopper 6 may be employed, such as a strap or clamp on the dispenser 2 which engages the stopper 6 and/or container 700, a socket positioned at a proximal end of the needle 4 that receives and engages with the protrusion on the stopper 6 that has the ridges 67 (e.g., in a way similar to a socket wrench engages with a bolt head or nut), and others.

Figure 4:
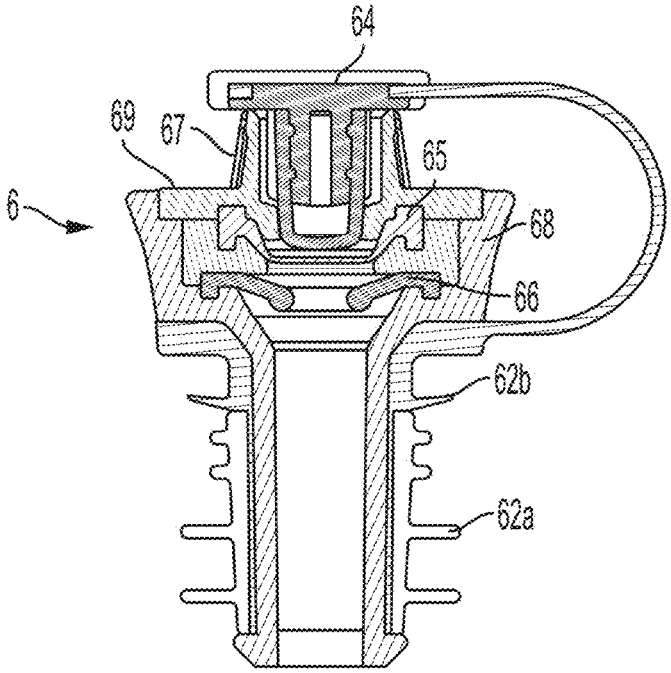
FIG. 4 shows a cross sectional view of stopper in alternate embodiment having a modified rib configuration.

FIG. 4 shows another illustrative embodiment of a stopper 6 that incorporates aspects of the invention. As with the embodiment shown in FIGS. 1 and 2, the stopper 6 of FIG. 4 includes one or more ribs 62 that extend radially from an insertion portion 63, but the stopper 6 employs ribs 62 that have different performance features. For example, the stopper 6 includes one or more distal ribs 62*a* arranged to engage with the container opening, and one or more proximal ribs 62*b* positioned proximally of the one or more distal ribs 62*a* and also arranged to engage with the container opening. However, the distal ribs 62*a* may have different features than the proximal ribs 62*b*. For example, the one or more distal ribs 62*a* may have a higher impermeability to oxygen than the one or more proximal ribs 62*b*. In this example, the stopper 6 has a body 68 with a molded plastic portion that defines the passageway 61, e.g., the molded plastic portion may be made of polypropylene or other material that is suitably resistant to oxygen permeation. However, a molded plastic material such as polypropylene may not be suitably resilient to engage with a container opening, particularly container openings that may vary in size. To provide a suitable friction fit engagement between the stopper 6 and the container 700, the proximal ribs 62*b* may be made of molded silicone rubber, which is highly resilient and can provide good frictional engagement with a container opening. However, silicone rubber may not provide a desired resistance to the passage of oxygen or other ambient gas, and thus the distal ribs 62*a* may be provided with a material that is suitably resilient to form a seal with the container opening while providing an oxygen barrier. In this embodiment, the one or more distal ribs 62*a* are formed on a sleeve that is positioned over a distal end of the molded plastic portion of the stopper body 68. The sleeve and distal ribs 62*a* may be made of an ethyl vinyl acetate (EVA) or other material that provides a suitable oxygen barrier with suitable resilience. Thus, the distal ribs 62*a* may provide a good oxygen or other gas barrier, while the proximal ribs 62*b* provide good frictional engagement with the container opening to hold the stopper 6 in place. This permits the stopper body 68 to be made of a more rigid, and suitably oxygen or other gas resistant, material such as polypropylene. The proximal ribs 62*b* may also be formed as part of a sleeve that is engaged over the body 68 as shown. Moreover, the cap 64 may be attached to the stopper body 68 by a tether if desired, and may be molded at the same time with the proximal ribs 62*b* as shown.

In some embodiments, portions of the stopper 6 that do not have desired oxygen or other gas barrier characteristics, whether because of material(s) used to form the portion and/or because of a relatively thin travel path is provided for gas through the portion, can be coated with a barrier material to provide the stopper portion with desired barrier characteristics. For example, the silicone rubber portion that includes the distal ribs 62*a* in FIG. 4 may be coated with a barrier material so the ribs 62*a* and other parts of the coated component provide a desired barrier function. Similar coatings may be provided on other elastomeric and/or rigid parts, e.g., molded plastic parts formed of elastomeric or rigid material. As an example, all of the portions of the FIG. 4 stopper may be coated with a barrier material, if desired.

As can also be seen in FIG. 4, the plurality of ridges 67 may be formed on a protrusion of a cover 69 that is engaged with an upper or proximal side of the stopper body 68. The cover 69 may also function to hold the radial seal 66 and the septum seal 65 in place on the stopper body 68. For example, the seals 65, 65 may be positioned in a cavity of the body 68, and then locked in place by securing the cover 69 to the body 68, e.g., by welding, snap fit, etc. The cover 69 may be made of a plastic material that provides a suitable oxygen barrier, such as polypropylene. In a similar way, the cap 64 may be made of a material to provide a suitable oxygen barrier and seal to resist the flow of fluid through the passageway 61. In this embodiment, the cap 64 includes an EVA sleeve that covers an end of the cap 64 that is inserted into the proximal end of the passageway 61.

Figure 5:
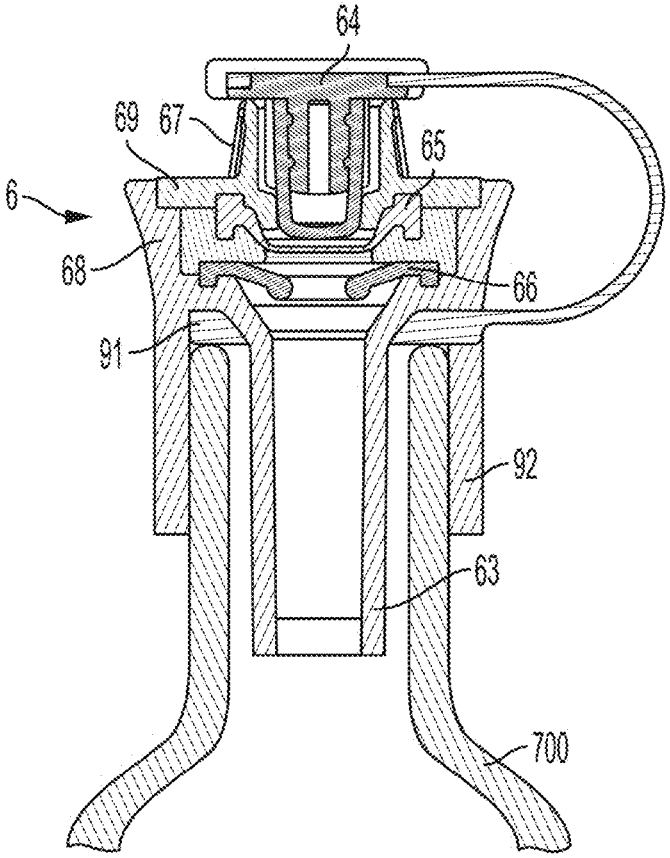
FIG. 5 shows a cross sectional view of stopper in alternate embodiment having an exterior engagement portion for engaging a container neck.

FIG. 5 shows another illustrative embodiment of a stopper 6 that may be employed with various aspects of the invention. This embodiment is similar to the FIG. 4 embodiment, e.g., includes a septum seal or other valve 65, a radial seal 66, cap 64, etc., but this FIG. 5 embodiment is arranged to engage with an exterior of a container neck as opposed to an interior surface of the neck at the container opening. In this embodiment, the body 68 has a sleeve or other portion that extends over a portion of the container neck and is arranged to engage with the container neck to secure the stopper 6 to the container 700. Thus, the body 68 includes an exterior engagement portion 92 that may engage with the container neck in any suitable way, such as by friction fit (e.g., silicone rubber or other resilient sleeve secured to and supported by the body 68 may fit tightly over the container neck), screw thread (such as where the container neck is threaded to secure a screw cap in place to close the container opening—the screw cap may be removed and the stopper 6 threaded in its place), and/or a locking or clamping mechanism (such as strap that may be tightened around the container neck, a buckle or bail-type fastener that tightens around the container neck, a one or more armed clamp that may use one or more arms to clamp onto the container neck, a collet, and others). Although the container neck in this embodiment is not shown having a lip near the container opening, some engagement portion 92 arrangements may engage with a lip of the container neck, such as by having a C-shaped clip, hooks or other element engage with a lower side of the lip to secure the stopper 6 in place. In other embodiments, the engagement portion 92 may employ one or more clamp arrangements described in U.S. Pat. No. 9,010,588, which is incorporated by reference for its teachings regarding various clamping arrangements for a dispenser device which may be alternately employed with a stopper 6. In this embodiment, the stopper 6 includes a seal 91 such as a resilient washer that engages with an upper or top surface of the container 700 around the container opening to form a fluid-tight seal, e.g., to resist gas or liquid flow out of the container 700. The seal 91 may be pressed downwardly against the container neck by the engagement portion 92 to provide suitable force to form the desired seal. Although in this embodiment the insertion portion 63 does not engage with the inner surface of the container neck at the opening, the insertion portion 63 could engage with the container neck, e.g., as shown in the FIG. 4 embodiment. Alternately, the insertion portion 63 may be eliminated entirely as no portion of the stopper 6 need extend into the container 700.

In yet another embodiment, the stopper may be arranged to engage with the inner surface of the container neck at the opening. For example, the stopper may include an expanding seal that can be expanded radially outwardly to contact and form a seal with the inner surface of the container neck. One such arrangement may include a pair of conical or frustoconical elements that are arranged with their narrow ends relatively near each other and wider ends more distant. A resilient seal ring may be positioned between the frustoconical elements and arranged so that when the frustoconical elements are moved toward each other, the inner portion of the seal ring is contacted by the elements so that the seal ring is pushed radially outwardly. This radially outward movement of the seal ring may continue until the outer surface of the seal ring contacts the inner surface of the neck, thus creating a seal as the seal ring is squeezed between the inner surface of the neck and the frustoconical elements. The frustoconical elements may be moved toward each other by a threaded rod or other suitable arrangement, and one of the frustoconical elements may have a narrow end received into an opening of the opposite frustoconical element, if necessary.

As noted above, the dispenser 2 may be arranged to automatically control gas flow, and thus dispensing of beverage. FIG. 2 shows an alternative arrangement including a controller 34 that is arranged to control operation of the gas flow valve 24. The controller 34 can be arranged to mechanically move the cap 241 of the gas flow valve 24 to operate the valve 24 (e.g., using a servomotor or other controllable motor drive), or the gas flow valve 24 could be arranged in other ways, such as an electrically-operated solenoid valve or other electrically-controllable valve. In this embodiment, the controller 34 includes an orientation sensor 35 constructed and arranged to detect an orientation of the body 3 of the dispenser 2. For example, in some embodiments, after the dispenser 2 is properly secured to a container 700, the controller 34 may detect whether the container 700 is in a pour or no-pour orientation, and automatically control the gas flow valve 24 to deliver gas to dispense beverage while in the pour orientation, but not while in the no-pour orientation. For example, the orientation sensor 35 may detect a pour condition when a bottom of the container 700 is positioned above an opening of the container 700 and/or when a longitudinal axis 701 of the container 700 (see FIG. 1) is rotated about a horizontal axis by at least 90 degrees, and/or other movement of the container 700 that represents beverage is to be dispensed from the container 700. To detect such conditions, the orientation sensor 35 may include one or more gyroscopes, accelerometers, mercury or other switches, etc., arranged to detect motion and/or position of the dispenser 2 and container 700 relative to gravity. In another embodiment, the orientation sensor 35 may detect a pour condition when beverage is in contact with the needle 4, e.g., so the beverage inlet 42 can receive beverage. For example, the orientation sensor 35 may include a conductivity sensor, float switch or other arrangement to detect the presence of liquid beverage at the distal end of the needle 4.

These conditions, or others, detected by the orientation sensor 35 can be used by the controller 34 to determine that the user has manipulated the container 700 to dispense beverage from the container 700, i.e., the container is in a pour orientation. In response, the controller 34 can control the gas flow valve 24 to dispense beverage from the container 700. For example, the controller 34 may detect that the container 700 has been rotated 90 degrees or more relative to an upward direction (i.e., a direction opposite to the direction of local gravitational force) and open the gas flow valve 24 to deliver pressurized gas into the container 700. Since in this embodiment, the flow path from the beverage inlet 42 to the dispense outlet 32 is always open, beverage may flow to the dispense outlet 32. Thereafter, the controller 34 may close the gas flow valve 24. As will be understood, the controller 34 may cause beverage to be dispensed intermittently, e.g., by alternately opening and closing the gas flow valve 24 to deliver pressurized gas into the container 700. Beverage dispensing can be controlled in other ways depending on a number of conduits in fluid communication with the container 700 and/or a valve arrangement. For example, if the dispenser 2 includes a beverage control valve to control flow in the needle beverage conduit and/or dispense outlet 32, the controller 34 could control operation of the beverage control valve to control flow of beverage from the container 700.

The controller 34 may continuously, periodically or otherwise monitor the orientation information from the orientation sensor 35 and control beverage dispensing accordingly. For example, if the orientation sensor 35 detects that the container 700 is no longer in a pour orientation, the controller 34 may stop beverage dispensing, such as by closing the gas flow valve 24 (and/or beverage control valve). If the dispenser 2 is again detected to be in a pour orientation, beverage dispensing may begin again.

In some embodiments, the controller 34 may control an amount or volume of beverage dispensed for each pouring operation, e.g., for each time the dispenser 2 is detected to be in a pour orientation and remains in the pour orientation for an extended period such as 1 second or more. For example, the controller 34 may be configured to dispense a predetermined amount of beverage, such as 1.5, 4 or 6 ounces/125 ml or 150 ml, for each pouring operation. In other arrangements, the controller 34 can receive user input to select one of two or more volume options, such as pouring a "taste" or relatively small amount, or pouring one or more larger volumes. Thus, the controller 34 may include a push button, voice control, or other user interface to receive selectable dispense volume information. Based on the selected pour volume, the controller 34 may control the operation of the valve(s) to dispense the selected amount. Note that controller 34 control of a dispense volume need not be coupled with an ability to detect whether a container is in a pour/no-pour orientation. Instead, a user may select a desired dispense volume and then press a button or other actuator to initiate dispensing. The controller 34 may stop dispensing when the selected volume has been dispensed, e.g., by closing a suitable valve.

The controller 34 can control how much beverage is dispensed in different ways. For example, the controller 34 may include a flow sensor arranged to detect an amount of beverage dispensed and control operation of the valve(s) based on information from the flow sensor. In another arrangement, the controller 34 may determine an amount of beverage dispensed based on a time that the gas flow valve 24 (or beverage control valve) is open for dispensing. Where a pressure in the container 700 and/or other dispense conditions are known (e.g., a gas or beverage flow rate through a needle 4 may be relatively constant even for a relatively wide range of pressures in the container), a time-based control of beverage volume corresponding to an open time for the gas flow valve 24 (or beverage control valve) may be sufficiently accurate. In another embodiment, the controller 34 may determine a flow rate from the container based on a pressure in the container 700, and thus may include a pressure sensor 39 to detect a value indicative of a pressure in the container 700. The pressure sensor 39 may have a sensor element positioned in the container (e.g., at an end of the needle 4), in a conduit between the gas source and the container, or in other suitable locations to provide an indication of pressure in the container 700. The pressure detected by the pressure sensor 39 may be used by the controller 34 to determine a flow rate of beverage from the container 700, and thus determine an amount of beverage dispensed (e.g., a flow rate of beverage out of the dispense outlet 32 may be related to pressure in the container 700, and by multiplying the flow rate(s) by a dispense time, the dispense volume may be determined).

Information from the pressure sensor 39 may also be used by the controller 34 to control a pressure in the container 700 to be within a desired range. For example, the controller 34 may control pressure in the container 700 to be within a desired range to ensure that beverage is dispensed at a suitably high rate and/or at a known flow rate. In another arrangement, the controller 34 may control the pressure in the container 700 to be somewhat lower, e.g., to preserve gas provided from the gas source 100 and dispense at a slower flow rate. In some cases, a user may be able to set the dispenser 2 to operate in different dispensing modes, such as "fast pour" or "save gas" modes in which the dispenser 2 operates to dispense beverage at a maximum or other relatively high rate using a relatively higher pressure in the container 700 (a fast pour mode) or operates to dispense beverage in a way that uses as little dispensing gas as possible by using a relatively lower pressure in the container 700 (a save gas mode). Alternately, a user could interact with the controller 34 to adjust the dispense rate up or down. Again, the user could provide the dispense speed information by a user interface of the controller 34 or other means, and a selectable dispense rate feature may be used with or without dispense volume control, e.g., where the controller 34 dispenses a specified volume of beverage.

In another embodiment, a dispenser may be arranged to determine a volume of beverage remaining in a container, and in one embodiment the volume of beverage in the container may be determined based on a change in pressure over a time period that pressurized gas is delivered to the container. For example, the dispenser 2 may include a source of pressurized gas 100 that is used to deliver gas into a container. The dispenser 2 may measure a rate at which pressure increases in the container 700, and based on the pressure rate change determine an amount of beverage in the container. The pressure of gas provided to the container may be regulated, e.g., so that gas is provided at a relatively constant pressure to the container during the pressure rate change measurement. Pressure in the container may be measured, e.g., using a pressure sensor 39, and as will be understood, the rate change of pressure in the container will tend to be lower for containers having less beverage volume and larger gas volume inside the container. The controller 34 may store a look-up table of values that each correspond an amount of beverage remaining with a detected pressure rate change, or may use an algorithm that employs a pressure rate change to determine a remaining volume of beverage. In another embodiment, the controller 34 need not include a pressure sensor 39, and may instead provide gas to the container at a regulated pressure until a pressure in the container equalizes with the regulated pressure. The time over which the container takes to equalize pressure may be used by the controller 34 to determine a remaining beverage volume, e.g., by look up table, algorithm, etc. The controller 34 may prevent beverage dispensing during a time that the container is pressurized during volume remaining measurement, or may dispense beverage during a pressurization period used to determine a volume of beverage in the container. (Dispensing of beverage during volume remaining measurement need not be problematic to determining the volume remaining since the controller 34 may store information regarding a rate at which flow out of the container occurs, and/or the algorithm, look up table, or other means by which a remaining volume is determined may be arranged to account for dispensing.)

In another embodiment, the dispenser 2 may be arranged to determine a volume of beverage remaining in a container based on a change in pressure in the container while beverage is being dispensed. For example, generally speaking, a container with a larger gas volume will experience a slower drop in pressure for a unit volume of beverage dispensed than a container with a smaller gas volume. This relationship may be used by the dispenser 2 to determine a remaining beverage volume in a container during dispensing. For example, a source of pressurized gas 100 may be used to deliver gas into a container, either before or during beverage dispensing, and the dispenser 2 may measure a rate at which pressure decreases in the container 700 during dispensing. Based on the pressure decrease rate, the controller 34 may determine an amount of beverage in the container. As in other embodiments, the pressure of gas provided to the container may be regulated, or may not be regulated. Pressure in the container may be measured, e.g., using a pressure sensor 39, as discussed above. To determine the remaining volume of beverage, the controller 34 may store a look-up table of values that each correspond an amount of beverage remaining with a detected pressure rate change, or may use an algorithm that employs a pressure rate change to determine a remaining volume of beverage. The determined amount of beverage remaining in the container 700 may be used to control gas delivery for dispensing, e.g., a container having a relatively small amount of remaining beverage may require a larger volume of gas for dispensing a given amount of beverage than a container that is more full. Thus, for example, the controller 34 may adjust gas flow valve 24 open times depending on a remaining amount of beverage in the container 700.

Where the controller 34 determines an amount of remaining beverage and the dispenser 2 is subsequently (or concurrently) used to dispense beverage, the controller 34 may adjust (reduce) the amount of remaining beverage by an amount of beverage dispensed. For example, the controller 34 may measure an amount of time that a beverage control valve is open and use that information to determine an amount of beverage dispensed. The dispensed beverage may be used to reduce the remaining amount earlier determined to update the remaining amount. Where the controller 34 dispenses during a time that the controller 34 determines an amount of remaining beverage, the controller 34 may take dispensed beverage into account, e.g., an algorithm used to determine an amount of remaining beverage may take beverage dispensed during the measurement operation into account. Note also that the controller 34 may use an amount of dispensed beverage to determine an amount of beverage remaining in a container. For example, when the dispenser 2 is associated with a container 700 that has never been accessed, the dispenser 2 may assume that the container 700 initially has a starting volume of beverage (e.g., 750 ml of wine), and may subtract an amount of beverage dispensed from the starting volume to determine a remaining volume in the container.

The controller 34 may use the determined remaining beverage information in different ways. For example, containers may have identifying indicia, such as an RFID tag, bar code, alphanumeric text, etc., and the controller 34 may associate the remaining beverage information with each specific container. This way, the controller 34 may store the amount of beverage remaining for each of a plurality of containers, and when the dispenser 2 is subsequently used with a previously used container, the controller 34 may display a remaining amount of beverage, such as on a visual display, by audibly announcing a remaining amount, etc. In another embodiment, the controller 34 may communicate a remaining amount of beverage to another device, such as a personal computer, server, smartphone or other device, whether by wireless or wired connection. As will be understood, a smartphone or other similar device may operate an application that enables communication with one or more dispensers 2, manages display of information and/or user input to the dispenser 2, etc. The application may also manage communication between the dispenser 2 and the smartphone, such as by Bluetooth or other wireless communication, so the devices may share information. This may allow a user to view on the smartphone or other device how much beverage is remaining, as well as other information such as a type of beverage in the container, how much gas is left in the gas source 100 or how much beverage can be dispensed with the remaining gas, a type of gas in the gas source 100 (e.g., argon, carbon dioxide, etc.), when a container was first accessed for dispensing, and/or a size of needle mounted on the device.

The controller 34 may also use an ability to detect whether the device is mounted to a container and/or detect features of a container in a variety of ways. For example, the controller 34 may detect whether the dispenser 2 is mounted to a container, e.g., by detecting that the needle has been inserted through a stopper, by detecting an RFID tag, barcode or other indicia on a container, by detecting activation of a clamp or other container engagement feature of the dispenser 2, etc., and in response initiate operation of the dispenser 2. For example, if a sensor associated with the dispenser 2 indicates that the dispenser 2 is secured to a container 700, the dispenser 2 may start to monitor its orientation and/or an orientation of an attached container to control beverage dispensing, may display gas and/or beverage remaining values, and so on, after detecting that the dispenser 2 is engaged with a container. Also, or alternately, other features regarding the container may be displayed, such as a type of beverage, a temperature of the beverage (where the dispenser 2 is outfitted with a temperature sensor), an indication of when the container was last accessed by the dispenser 2, suggestions for food pairing with the beverage, and so on. As noted above, information may be relayed from the dispenser 2 to a user's smartphone or other device for display to the user, whether by visual indication, audible indication, etc. The dispenser 2 may also use sensed information to access other information, e.g., stored remotely on a webserver, to provide additional information to a user. For example, a dispenser 2 may be equipped with a temperature sensor to detect a temperature of the container itself and/or beverage in the container. Based on the temperature information, and possibly a type of beverage, the dispenser 2 may access stored information to determine if the beverage is within a desired temperature range for suitable serving. If not, the dispenser 2 may indicate the beverage temperature with information regarding optimal serving temperatures.

In some embodiments, the controller 34 may be arranged to determine and track an amount of gas in the gas source, such as a compressed gas cylinder. Such information may be useful, e.g., to alert a user that a gas source is about to run out. For example, in one embodiment the controller may have a pressure sensor 39 arranged to detect a pressure of gas in the gas cylinder 100, and use the detected pressure to determine how much gas remains in the cylinder. This information may be used by the controller 34 to provide information to a user that the cylinder 100 should be replaced, a warning that the cylinder may run out soon, etc. In another embodiment, the controller 34 may determine a pressure in the gas cylinder or other value indicative of an amount of gas left in the cylinder based on an amount of time that a gas flow valve 24 is open to cause gas delivery into the container. For example, where a regulator is provided, the controller 34 may store information that represents a total time that the gas source 100 can deliver gas at the regulated pressure. When a gas cylinder or other source 100 is replaced, the controller 34 may detect the replacement and then track a total time that gas is delivered from the gas source 100, e.g., based on how long a gas flow valve 24 is open. The total delivery time may be used to indicate an amount of gas left in the source 100, e.g., ¾ full, ½ full, etc., and/or indicate when the source 100 is about to run out. The controller 34 may also refuse to perform a dispensing operation where the gas source 100 does not have sufficient gas to perform the operation. In other arrangements, the controller 34 may determine an amount of gas remaining in a gas source 100 based on how much beverage is dispensed. As discussed above, the controller 34 may determine how much beverage is dispensed from one or more containers, and determine an amount of gas remaining in a gas source 100 based on how much total beverage has been dispensed using the gas source 100. For example, the controller 34 may store information regarding a total number of ounces or other volume measurement a gas source 100 can be used to dispense, and the controller 34 may display an amount of gas remaining that corresponds to the amount of beverage dispensed.

In another embodiment, the dispenser 2 may be arranged to stop beverage dispensing while in a pour orientation. For example, the orientation sensor 35 may detect rotation of the container about a longitudinal axis 701 of the container while in a pour orientation and in response the controller 34 may stop dispensing of beverage. That is, similar to the way a person may rotate a wine bottle about its longitudinal axis when stopping pouring of wine into a glass, the dispenser 2 may detect similar rotation of a container and stop dispensing, even if the container remains in a pour orientation. Rotation of the container about the longitudinal axis in an opposite direction while the container is in a pour orientation may be sensed and the controller 34 may resume dispensing. Alternately, the controller 34 may not again begin dispensing until the container is put in a no-pour orientation and then a pour orientation. Note that this aspect may be combined with an auto-pour feature discussed above where the dispenser 2 senses a container is in a pour orientation and begins beverage dispensing, or may be used independently. For example, the dispenser 2 may be arranged to begin dispensing in response to a user's command, such as pressing a button, and may stop dispensing in response to detecting rotation of the container about its longitudinal axis. Sensing of rotation of the container 700 about its longitudinal axis may be performed by the same or similar sensors discussed above for detecting whether the container is in a pour orientation, e.g., accelerometers, gyroscopes, mercury or other switches, etc.

Control of the system may be performed by any suitable control circuitry of the controller 34, which may include a programmed general purpose computer and/or other data processing device along with suitable software or other operating instructions, one or more memories (including non-transient storage media that may store software and/or other operating instructions), a power supply for the control circuitry and/or other system components, temperature and liquid level sensors, pressure sensors, RFID interrogation devices or other machine readable indicia readers (such as those used to read and recognize alphanumeric text, barcodes, security inks, etc.), input/output interfaces (e.g., such as the user interface to display information to a user and/or receive input from a user), communication buses or other links, a display, switches, relays, triacs, motors, mechanical linkages and/or actuators, or other components necessary to perform desired input/output or other functions.

Different needle 4 lengths can be adapted to work properly in various embodiments, but it has been found that a minimum needle length of about 1.5 inches allows for a stopper 6 that suitably engages a container opening while allowing the needle to pass through the stopper passageway 61. Needles as long as 9 inches or more could be employed, but a length range of between 2 and 5 inches has been found suitable.

In some embodiments, a suitable gas pressure is introduced into a container to extract beverage from the container. For example, with some wine bottles, it has been found that a maximum pressure of between around 40 and 50 psi may be introduced into the bottle without risking leakage at, or ejection of, a stopper, although pressures of between around 2 and 30 psi have been found to work well. These pressures are well tolerated by even relatively weak stopper-bottle seals at the bottle opening without causing the stopper to dislodge or passage of liquid or gas by the stopper, and provide for relatively fast beverage extraction. The lower pressure limit in the container during wine extraction for some embodiments has been found to be between about 0 and 20 psi. That is, a pressure between about 0 and 20 psi has been found needed in a bottle to provide a suitably fast extraction of beverage from the bottle.

The source of pressurized gas can be any of a variety of regulated or unregulated pressurized gas containers filled with any of a variety of non-reactive (or optionally reactive, such as air) gasses. In a preferred embodiment, the gas cylinder contains gas at an initial pressure of about 2000-3000 psi. This pressure has been found to allow the use of a single relatively small compressed gas cylinder (e.g., about 3 inches in length and 0.75 inches in diameter) for the complete extraction of the contents of several bottles of wine. Multiple gasses have been tested successfully over extended storage periods, and preferably the gas used is non-reactive with the beverage within the container, such as wine, and can serve to protect the beverage oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The invention claimed is:

1. A beverage dispenser comprising:

a pressurized gas receiver arranged to fluidly couple with a pressurized gas source and conduct flow of pressurized gas along a primary gas conduit, the primary gas conduit including a piercing lance arranged to pierce a cap of a pressurized gas cylinder, the piercing lance having a flow path through which pressurized gas from the pressurized gas cylinder flows into the primary gas conduit and a flow restrictor that is a part of the piercing lance and is arranged in the flow path of the piercing lance to reduce a flow rate and pressure of gas flowing in the primary gas conduit;

a gas flow valve fluidly coupled to the primary gas conduit and arranged to control flow of gas from the primary gas conduit to a secondary gas conduit, the gas flow valve being operable by a user to open to permit gas flow to the secondary gas conduit and to close to stop gas flow to the secondary gas conduit;

a regulator fluidly coupled between the piercing lance and the gas flow valve, the regulator arranged to receive pressurized gas from the flow restrictor and further reduce a pressure of gas provided to the gas flow valve, the piercing lance and the regulator defining at least in part the primary gas conduit; and a needle including a needle gas conduit fluidly coupled to the secondary gas conduit and arranged to deliver pressurized gas to a distal end of the needle, the needle further including a needle beverage conduit arranged to conduct a flow of beverage from the distal end of the needle to a dispensing outlet.

2. The dispenser of claim 1, wherein the flow restrictor has an orifice with a diameter of 0.2 mm to 0.4 mm.

3. The dispenser of claim 1, wherein the flow restrictor is arranged to provide a flow rate of 0.7 L/min to 5 L/min.

4. The dispenser of claim 1, further comprising a second flow restrictor in the secondary gas conduit, the second flow restrictor arranged to reduce a flow rate and pressure of gas flowing in the secondary gas conduit.

5. The dispenser of claim 1, further comprising a body that houses the primary gas conduit, gas flow valve, and secondary gas conduit, and wherein the needle extends from a portion of the body.

6. The dispenser of claim 1, wherein the regulator includes a regulator valve with a piston movable to open and close the regulator valve based on a gas pressure inside of the piston and a spring force exerted on an outside of the piston.

7. The dispenser of claim 1, further comprising a body that houses the primary gas conduit, gas flow valve, and secondary gas conduit, and further comprising a controller arranged to automatically control operation of the gas flow valve based on an orientation of the body.

8. The dispenser of claim 1, wherein the needle gas conduit is positioned inside of the needle beverage conduit.

9. The dispenser of claim 1, wherein the needle gas conduit delivers pressurized gas to an extreme distal tip of the needle, and the needle beverage conduit has one or more beverage inlet openings positioned proximal of the extreme distal tip of the needle.

10. The dispenser of claim 1, further comprising a body that houses the primary gas conduit, gas flow valve, and secondary gas conduit, and wherein the needle extends from a portion of the body, the body includes a handle that is grippable by a user, and the dispensing outlet includes a tube that extends from the body to dispense beverage.

11. The dispenser of claim 1, further comprising a stopper arranged to engage with an opening of a beverage container and having a passageway extending from a distal end to a proximal end, the stopper further including a seal positioned between the distal and proximal ends of the passageway, the seal arranged to sealingly engage with the needle with the needle inserted through the passageway so as to position the distal end of the needle beyond the distal end of the passageway.

12. The dispenser of claim 11, wherein the stopper further includes a septum seal positioned proximally in the passageway relative to the seal, the septum seal arranged to resist fluid flow through the passageway and arranged to permit the needle to be inserted through the passageway.

13. The dispenser of claim 11, wherein the stopper further includes a cap arranged to close the passageway to fluid flow at the proximal end of the passageway.

14. The dispenser of claim 11, wherein the stopper further includes an insertion portion arranged to be inserted within the opening of the container, the insertion portion including one or more ribs extending radially outwardly from the insertion portion to engage with container openings of different size and resist fluid flow in a space between the stopper and the container opening.

15. The dispenser of claim 11, wherein the stopper includes a plurality of ridges that extend around a portion of the stopper, and the dispenser is configured to engage with one or more of the plurality of ridges to resist rotation of the dispenser relative to the stopper.

16. The dispenser of claim 15, wherein the dispenser includes a detent configured to engage with one or more of the plurality of ridges.

17. The dispenser of claim 1, further comprising a second flow restrictor in the secondary gas conduit, the second flow restrictor arranged to reduce a flow rate and pressure of gas flowing in the secondary gas conduit, and wherein the flow restrictor and the secondary flow restrictor are arranged to provide a flow rate of 0.7 L/min to 5 L/min to the needle gas conduit.

* * * * *